US010974870B2

(12) United States Patent
Milbrandt et al.

(10) Patent No.: US 10,974,870 B2
(45) Date of Patent: Apr. 13, 2021

(54) CLOSURE ARTICLE WITH AUXILIARY FASTENER

(71) Applicant: Bedford industries, Inc., Worthington, MN (US)

(72) Inventors: Jay Milbrandt, Worthington, MN (US); David Schiller, Sioux Falls, SD (US); Trevor Wintz, Round Lake, MN (US); Jeffrey Tschetter, Sioux Falls, SD (US); Colin O'Donnell, Worthington, MN (US)

(73) Assignee: BEDFORD INDUSTRIES, INC., Worthington, MN (US)

( * ) Notice: Subject to any disclaimer, the term of this patent is extended or adjusted under 35 U.S.C. 154(b) by 0 days.

(21) Appl. No.: 16/842,056

(22) Filed: Apr. 7, 2020

(65) Prior Publication Data

US 2020/0231338 A1 Jul. 23, 2020

Related U.S. Application Data

(63) Continuation of application No. 16/358,047, filed on Mar. 19, 2019, now Pat. No. 10,647,475.
(Continued)

(51) Int. Cl.

| | |
|---|---|
| ***G09F 3/04*** | (2006.01) |
| ***B65D 33/14*** | (2006.01) |
| ***B65D 33/16*** | (2006.01) |
| ***B65D 75/02*** | (2006.01) |
| ***B65D 71/06*** | (2006.01) |
| ***B65D 71/50*** | (2006.01) |
| ***B65D 23/14*** | (2006.01) |
| *B65D 23/00* | (2006.01) |

(52) U.S. Cl.
CPC ..... *B65D 33/1625* (2013.01); *B65D 23/14* (2013.01); *B65D 71/063* (2013.01); *B65D 71/504* (2013.01); *B65D 75/02* (2013.01); *B65D 23/003* (2013.01); *B65D 2563/10* (2013.01); *B65D 2571/00141* (2013.01)

(58) Field of Classification Search
CPC .. B65D 33/1625; B65D 71/504; B65D 23/14; B65D 71/063; B65D 75/02; B65D 23/003; B65D 2563/10; B65D 2571/00141; Y10T 24/155; Y10T 24/157; Y10T 24/15; Y10T 24/31; Y10T 24/3437; Y10T 24/3484; Y10T 24/1406; Y10T 24/141; Y10T 24/1498; Y10T 24/1402; G09F 2003/027; G09F 3/14; G09F 3/16; G09F 3/02; G09F 3/00; A47F 5/0006; B63D 71/504
USPC ..... 40/673, 662, 663
See application file for complete search history.

(56) References Cited

U.S. PATENT DOCUMENTS 4,631,783 A 12/1986 Hayashi
4,896,366 A 1/1990 Oxman
(Continued)

FOREIGN PATENT DOCUMENTS

FR 2 546 135 A1 11/1984

*Primary Examiner* — Jack W Lavinder
(74) *Attorney, Agent, or Firm* — Mai-Tram D. Lauer; Westman, Champlin & Koehler, P.A.

(57) ABSTRACT

In one aspect, an article includes a tag, an elastic panel, and a tab. The tag has a perimeter. The tag includes an aperture and a first cut connecting the aperture and the perimeter. The elastic panel is bonded to the tag. The tab is bonded to the elastic panel at a joint, wherein a portion of the tab is configured for insertion into the aperture.

20 Claims, 10 Drawing Sheets

Related U.S. Application Data

(60) Provisional application No. 62/645,460, filed on Mar. 20, 2018.

(56) References Cited

U.S. PATENT DOCUMENTS

| | | | | |
|---|---|---|---|---|
| 6,695,364 | B2 | 2/2004 | Bierlin | |
| 9,676,536 | B2 * | 6/2017 | Milbrandt | B65D 73/0071 |
| D871,212 | S | 12/2019 | Hamel | |
| D880,296 | S | 4/2020 | Hamel | |
| 2009/0188144 | A1 * | 7/2009 | Ludlow | G09F 3/02 40/665 |
| 2010/0139133 | A1 * | 6/2010 | Adams | G09F 3/04 40/299.01 |
| 2020/0095022 | A1 | 3/2020 | Hamel | |

* cited by examiner

CLOSURE ARTICLE WITH AUXILIARY FASTENER

CROSS REFERENCE TO RELATED APPLICATION

This application is a continuation of U.S. patent application Ser. No. 16/358,047, filed Mar. 19, 2019, which claims the benefit of priority from U.S. Provisional Patent Application No. 62/645,460, filed on Mar. 20, 2018 to "Closure Article with Auxiliary Fastener;" these priority applications are fully incorporated by reference.

BACKGROUND

Plastic closure articles commonly known as "clip tags" are well known, as described in U.S. Pat. No. 4,026,413 to Britt and U.S. Pat. No. 4,911,293 to Holmes, for example. Such a clip tag is commonly used to close a flexible container such as a plastic bag. An open end of the bag is typically gathered and then inserted through a slit on the tag, so that the gathered bag is frictionally held in a hole of the tag.

SUMMARY

In one aspect, an article is configured to close a first product and attach to a second product. The article includes a tag and a fastener. The tag has a perimeter. The tag includes an aperture and a first cut connecting the aperture and the perimeter. The aperture and first cut are configured to accept a portion of the first product. The fastener is connected to the tag at a joint, wherein the fastener is configured to attach to the second product.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

The illustrations and written description depict and discuss several embodiments of closure articles having an auxiliary fastener. Components of the articles are described and shown with reference numbers. Such reference numbers, when used alone, refer to the described elements in general, such as with respect to one or more of the described embodiments.

Figure 14:
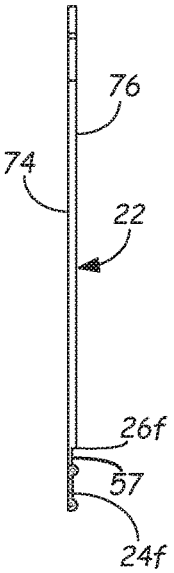
FIG. 14 is a side cross-sectional view of a seventh exemplary embodiment of a closure article, taken along line 14-14 of FIG. 13.
Figure 15:
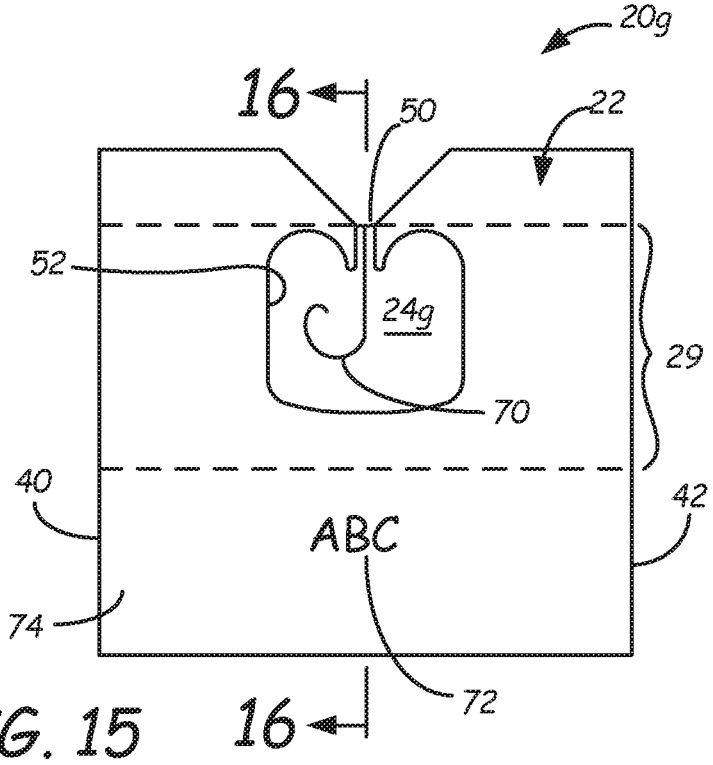
FIG. 15 is a front view of an eighth exemplary embodiment of a closure article.
Figure 16:
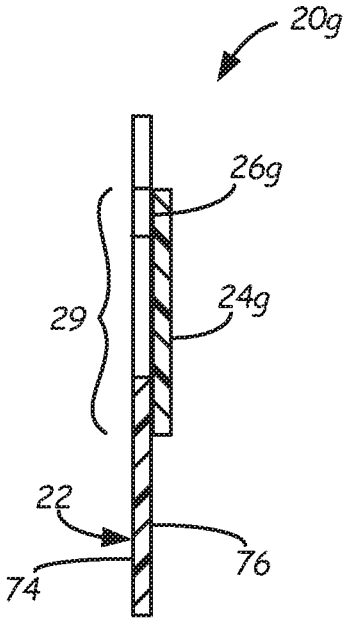
FIG. 16 is a cross-sectional view taken along line 16-16 of FIG. 15.
Figure 17:
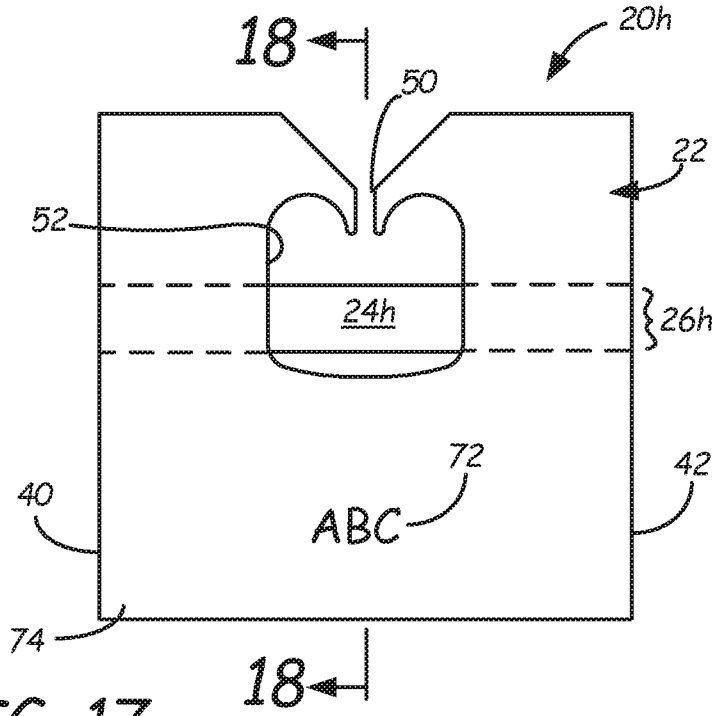
FIG. 17 is a front view of a ninth exemplary embodiment of a closure article.
Figure 18:
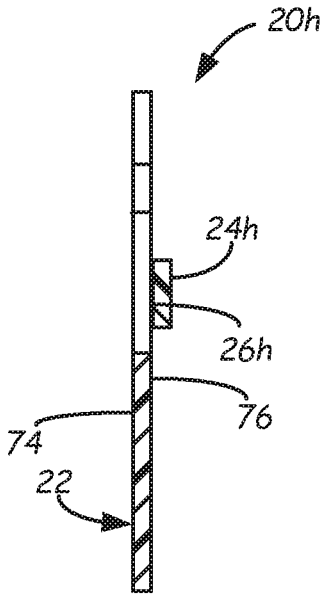
FIG. 18 is a cross-sectional view taken along line 18-18 of FIG. 17.

It is contemplated that many other changes in form and configuration are possible that fall within the scope of the present descriptions. In an exemplary embodiment, closure article 20 includes tag 22 and auxiliary fastener 24. As shown in FIGS. 1-7 and 25, auxiliary fastener 24*a*, 24*b*, 24*c* is provided in the form of an elastomer loop. As shown in FIGS. 8 and 26, auxiliary fastener 24*d* is provided in the form of a twist tie article. As shown in FIGS. 9-14, 27 and 28, auxiliary fastener 24*e*, 24*f* is provided in the form of a tin tie article. As shown in FIGS. 15 and 16, auxiliary fastener 24*g* is provided in the form of an elastomer sheet having a curved cut. As shown in FIGS. 17 and 18, auxiliary fastener 24*h* is provided in the form of an elastomer band. As shown in FIGS. 19-24, auxiliary fastener 24*i*, 24*j* is provided in the form of an elastomer strap having a tab. However, in other embodiments, the auxiliary fastener will take other forms, being made in some cases of other materials in different configurations than that shown in the illustrated embodiments.

Typically, the closure articles 20 described in this disclosure include the provision of a tag 22 having a form and function similar to known clip tags. In an exemplary embodiment, tag 22 is formed of a polymer sheet having a perimeter and includes a cut or slit 50 connecting the perimeter and an aperture 52. Many configurations of tag 22 and specifically of aperture 52 can be used. Articles 20 also provide an auxiliary fastener 24 that can be used for attachment to the same product that is attached to tag 22 or may be used to attach, bundle, or otherwise connect a second product to closure article 20.

Figure 1:
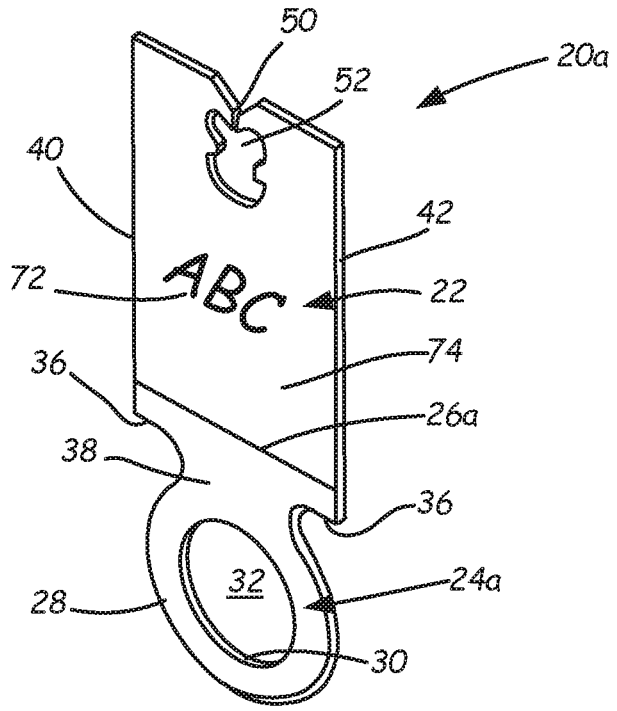
FIG. 1 is a perspective view of a first exemplary embodiment of a closure article with a tag and an auxiliary fastener.
Figure 2:
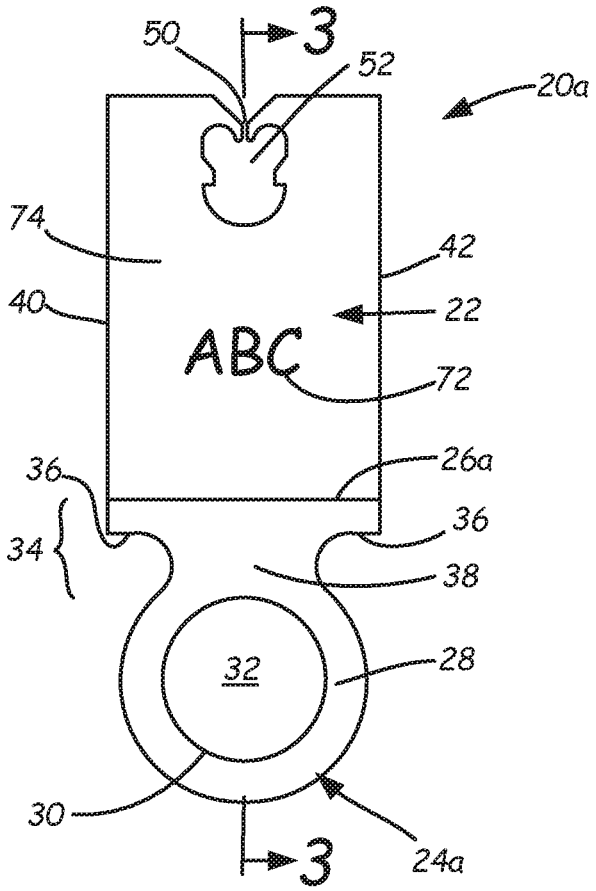
FIG. 2 is a front view of the article of FIG. 1.
Figure 3:
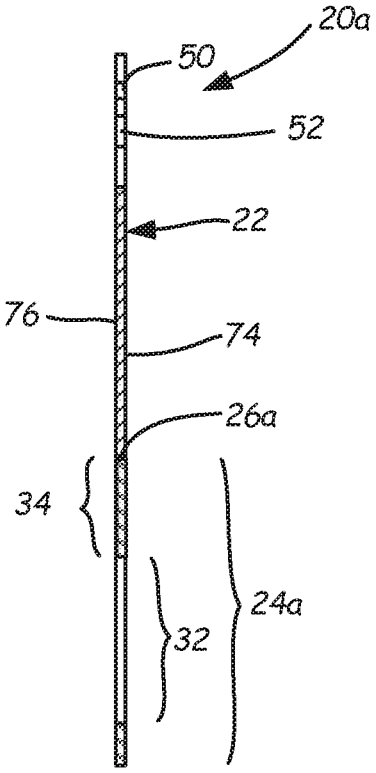
FIG. 3 is a cross-sectional view, taken along line 3-3 of FIG. 2.

As shown in FIGS. 1-3, closure article 20*a* is formed in an exemplary embodiment by cohesion of the materials for tag 22 and auxiliary fastener 24*a*, resulting in a joint 26*a* at an interface of tag 22 and auxiliary fastener 24*a*. In the illustrated embodiment, joint 26*a* is a butt joint, in which tag 22 and auxiliary fastener 24*a* meet at a single, substantially planar interface. In an exemplary embodiment, auxiliary fastener 24 is formed from a flexible elastic layer that extends away from the tag 22 and is configured with an elastic fastening loop 28. The entire article 20 is sheet-like in the sense that tag 22 is formed as a sheet of a flat nature and auxiliary fastener 24 is also formed as a sheet of flat character (although auxiliary fastener 24 in particular may be drapeable and floppy and thus not always displayed in flat form). The tag 22 and auxiliary fastener 24 are joined so that the sheet character of each extends onto the sheet character of the other, giving a total unitary sheet-like character to the entire article 20.

The flexible elastic fastening loop 28 has an inner perimeter edge 30 that defines the boundary of an aperture 32 through the loop 28. While aperture 32 is illustrated as circular, it is contemplated that an aperture through a fastening loop can have any of a variety of closed shapes, including regular and irregular polygons, rounded shapes, and holes having outlines with segments that are curved, straight, and combinations thereof. In the exemplary embodiments, aperture 32 is spaced from joint 26*a*.

Dispersion zone 34 is defined between aperture 32 and joint 26. Its function is to disperse at least some of the in-line tension forces created as a result of the stretching of elastic loop 28 to allow the passage therethrough of a portion of a product, as discussed below. Those tension forces are called "in-line" tension forces because they are in the line of stretching of the loop 28. Dissipation of such tension forces is desirable at least to some extent so as to reduce (or sometimes even substantially eliminate) the stress of that tension passing into the joint 26. In an exemplary embodiment, a length dimension of dispersion zone 34 between aperture 32 and joint 26 is at least about 50 mils (1.27 mm) and is more typically about ⅛ inch (125 mils or 3.18 mm) or greater.

In exemplary embodiments, lateral shoulders 36 are located on both sides of neck 38 and assist in relieving or dissipating tensioning forces within a stretched loop 28 from being transmitted into the joint 26 at its lateral edges. Thus, a relatively weaker unification between the tag 22 and the auxiliary fastener 24 at the joint 26 is sufficient as compared to that required in a structure without neck 38 and shoulders 36. However, other embodiments of an auxiliary fastener 24 may not have a narrowed neck region 38 or lateral shoulders 26.

In an exemplary embodiment, article 20 has a width between side edges 42, 44 between about 0.25 inch (6.35 mm) and about 1 inch (25.4 mm). In an exemplary embodiment, article 20 has a length (substantially orthogonal to its width) between about 1 inch (25.4 mm) and about 6 inches (152.4 mm). In exemplary embodiments, a length of auxiliary fastener 24 extending away from joint 26 is between about 0.5 inch (12.7 mm) and about 5 inches (127 mm).

Figure 4:
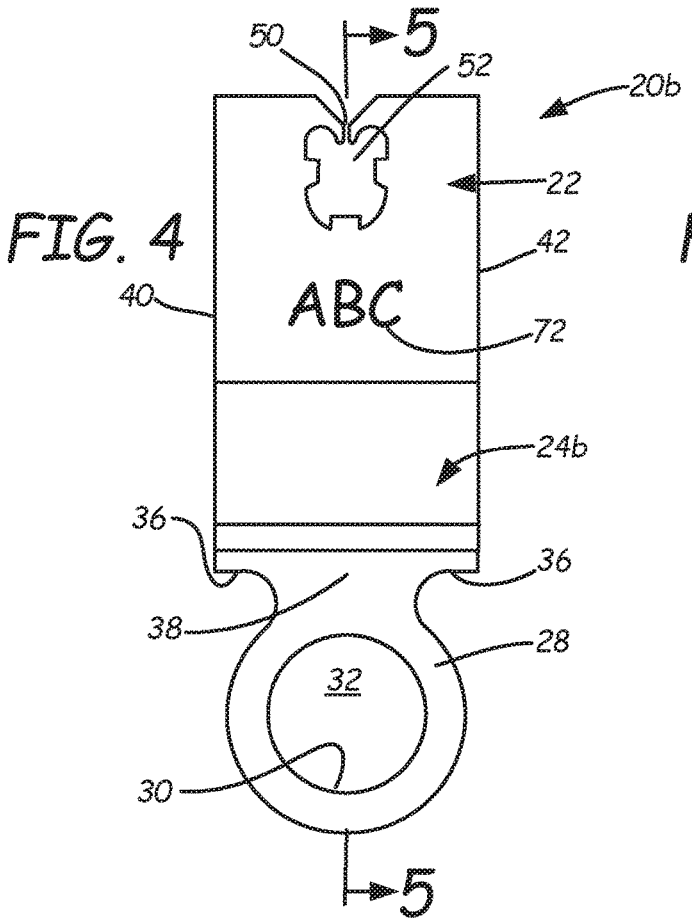
FIG. 4 is a back view of a second exemplary embodiment of a closure article.
Figure 5:
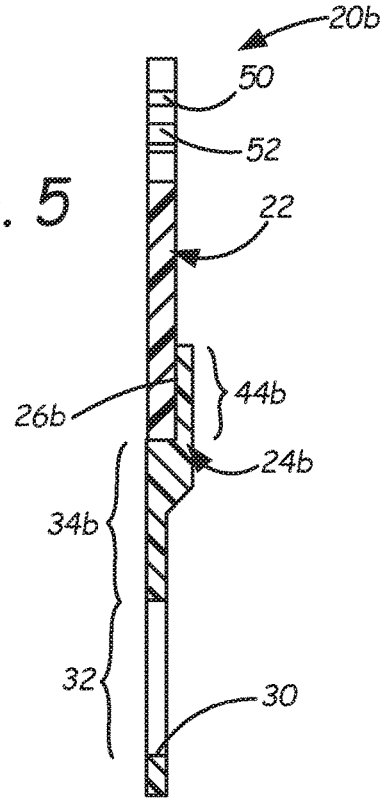
FIG. 5 is a cross sectional view, taken along line 5-5 of FIG. 4.

FIGS. 4 and 5 depict a second exemplary embodiment of a closure article 20*b*. Closure article 20*b* is similar to closure article 20*a*, except that auxiliary fastener 24*b* is attached to tag 22 at a joint 26 formed by an overlap of the flexible elastic material of auxiliary fastener 24*b* and the typically more rigid material of tag 22. Joint 26*b* is disposed at the bonded, coextensive overlap of the tag 22 and an elastic layer of auxiliary fastener 24*b*. In the illustrated embodiments, bond zone 44 has a generally rectangular configuration, due to the shapes of the overlapping portions of tag 22 and auxiliary fastener 24*b*. However, it is contemplated that such overlapping portions may have any shape, including those formed with irregular edges. The length of bond zone 44 is generally about 3/16 (4.76 mm) or ¼ inch (6.35 mm) or even ⅜ inch (9.53 mm), but is usually not over about ½ inch (12.7 mm). Tag 22 interfaces auxiliary fastener 24*b* along joint 26*b* so that a sheet character of each of tag 22 and auxiliary fastener 24*b* extends onto the sheet character of the other, giving a total unitary sheet-like character to the entire article 20*b*.

Figure 6:
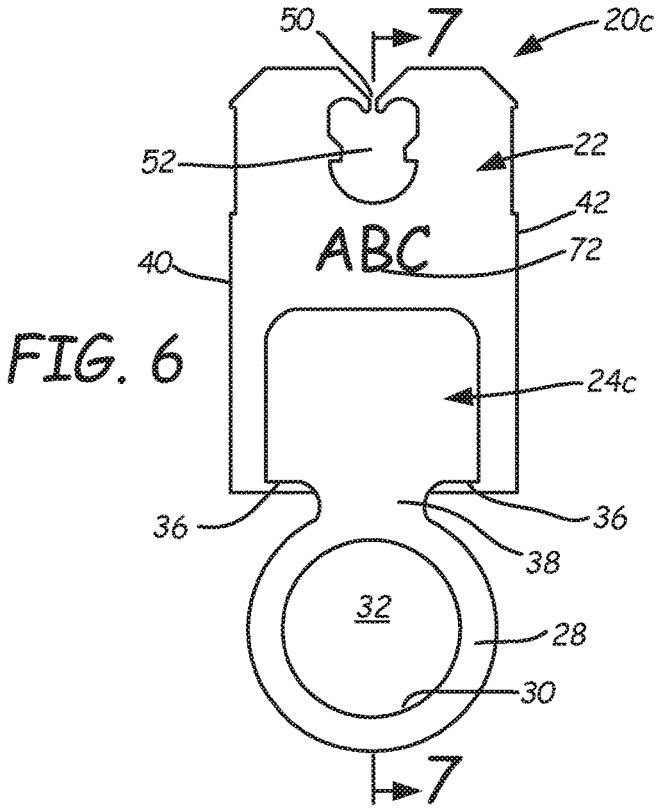
FIG. 6 is a back view of a third exemplary embodiment of a closure article.
Figure 7:
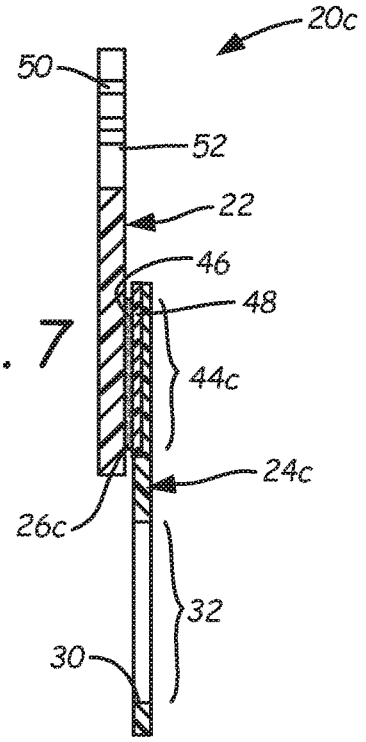
FIG. 7 is a cross sectional view, taken along line 7-7 of FIG. 6.
Figure 8:
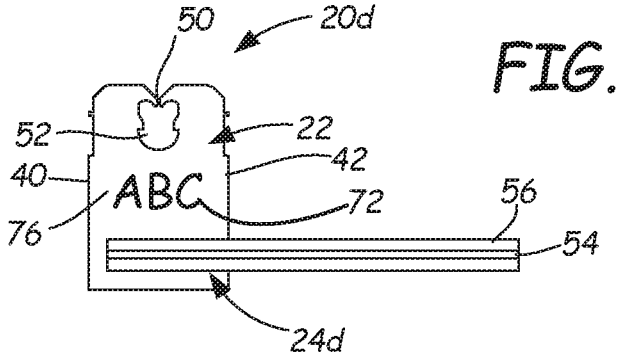
FIG. 8 shows a fourth exemplary embodiment of a closure article.

FIGS. 6 and 7 show a third exemplary embodiment of a closure article 20*c*. In this embodiment, auxiliary fastener 24*c* is attached to tag 22 at bond zone 26*c*, which includes adhesive layer 46. Accordingly, auxiliary fastener 24*c* may be produced separately from tag 22, rather than requiring all components of closure article 20*c* be manufactured in a single processing run. In an exemplary embodiment, auxiliary fastener 24*c* includes a backer sheet 48 bonded to an elastic sheet material, wherein the backer sheet 48 is a substantially non-stretchable or inextensible structural support layer, which facilitates enhanced bonding of the adhesive layer 46 to auxiliary fastener 24*c*. In an embodiment where tags 22 and auxiliary fastener 24*c* are provided separately to a user, a release liner (not shown) may be provided over adhesive layer 46 to mask adhesive layer 46 until its exposure is desired for attachment to tag 22.

FIG. 8 shows a fourth exemplary embodiment of closure article 20*d*. In this embodiment, auxiliary fastener 24*d* is provided in the form of a twist-tie fastener. Such fasteners are commonly known as including a retention wire 54 sandwiched between elongated strips of sheet material 56, which form wings around the retention wire 54. Auxiliary fastener 24*d* can be attached to tag 22 by an adhesive similar to adhesive layer 46 described above. Alternatively, auxiliary fastener 24*d* can be formed with tag 22 in an in-line web-based process. While auxiliary fastener 24*d* is illustrated as extending past side edge 42 of tag 22, it is contemplated that auxiliary fastener 24*d* may be positioned otherwise on tag 22, such as extending past side edge 40 but not side edge 42, or extending past both side edges 40, 42, for example.

Figure 9:
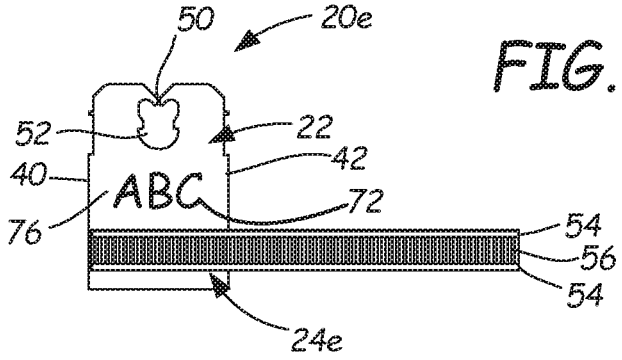
FIG. 9 shows a fifth exemplary embodiment of a closure article.
Figure 10:
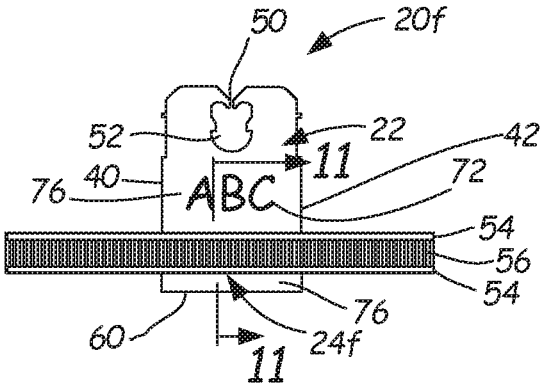
FIG. 10 shows a sixth exemplary embodiment of a closure article.
Figure 11:
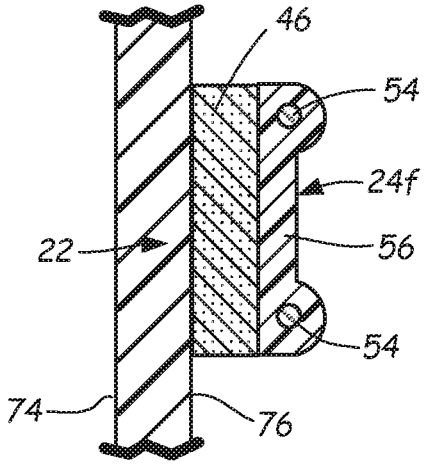
FIG. 11 is a partial cross-sectional view, taken along line 11-11 of FIG. 10.

FIGS. 9 and 10 show embodiments of closure articles 20*e* and 20*f*. These articles are similar in that an auxiliary fastener 24*e*, 24*f* is provided in the form of a tin-tie fastener having two spaced apart retention wires 54 embedded in a strip 56. Closure articles 20*e*, 20*f* differ in the placement of the tin-tie fastener 24*e*, 24*f* with respect to tag 22. As shown in FIG. 9, auxiliary fastener 24*e* of closure article 20*e* is offset (i.e., asymmetrically positioned) with respect to tag 22 so that auxiliary fastener 24*e* extends past only one side edge 42 of tag 22. In contrast, as shown in FIG. 10, auxiliary fastener 24*f* of closure article 20*f* is substantially centered to extend about equidistantly away from both side edges 40, 42 of tag 22. As shown in FIG. 11, in closure article 20*f*, and also applicable to closure article 20*e*, an adhesive layer 46 may be used to adhere the closure article 24*e*, 24*f* to tag 22. Alternatively, closure article 24*e*, 24*f* could be formed integrally with tag 22 in an in-line web-based process.

Figure 12:
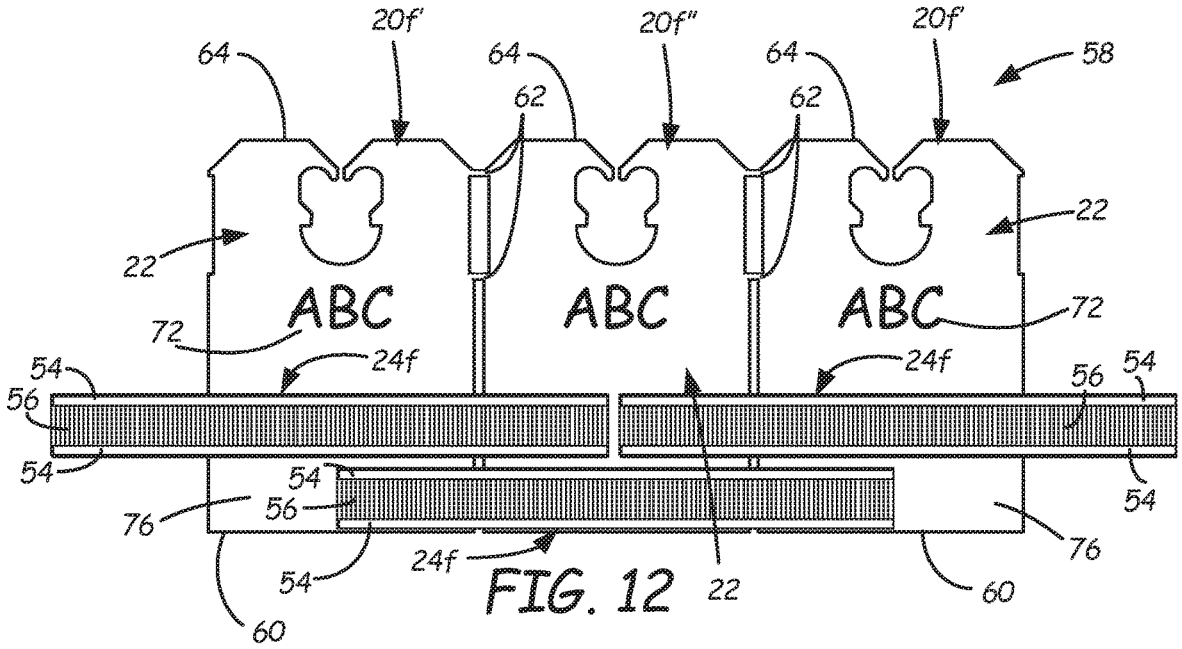
FIG. 12 shows a first exemplary arrangement of a plurality of closure articles.

FIG. 12 is a front view of a first exemplary arrangement 58 of a plurality of rupturably connected closure articles 20*f*', 20*f*". Each of these closure articles is similar to closure article 20*f* of FIG. 10, except that the placement of auxiliary fastener 24*f* on tag 22 is slightly different. For example, in closure article 20*f*', auxiliary fastener 24*f*' is spaced from a bottom edge 60 of tag 22 to allow for the nesting of the auxiliary fastener 24*f*" of an adjacent closure article 20*f*". In the illustrated embodiment, adjacent tags 22 are rupturably connected to each other via joints 62, which form breakable bridges between adjacent tags 22. Thus, a plurality of closure devices 20*f*', 20*f*" can be presented to a user in a connected arrangement 58, which may be provided in a flat or rolled spooled form. While only three such closure devices 20*f*', 20*f*" are illustrated, it is to be understood that the arrangement 58 can include any number of closure articles 20*f*', 20*f*" alternately arranged along a length parallel to bottom edge 60. Moreover, an arrangement may include another row of rupturably connected closure articles attached at bottom edge 60 of each of tags 22 and/or top edge 64 of tags 22.

Figure 13:
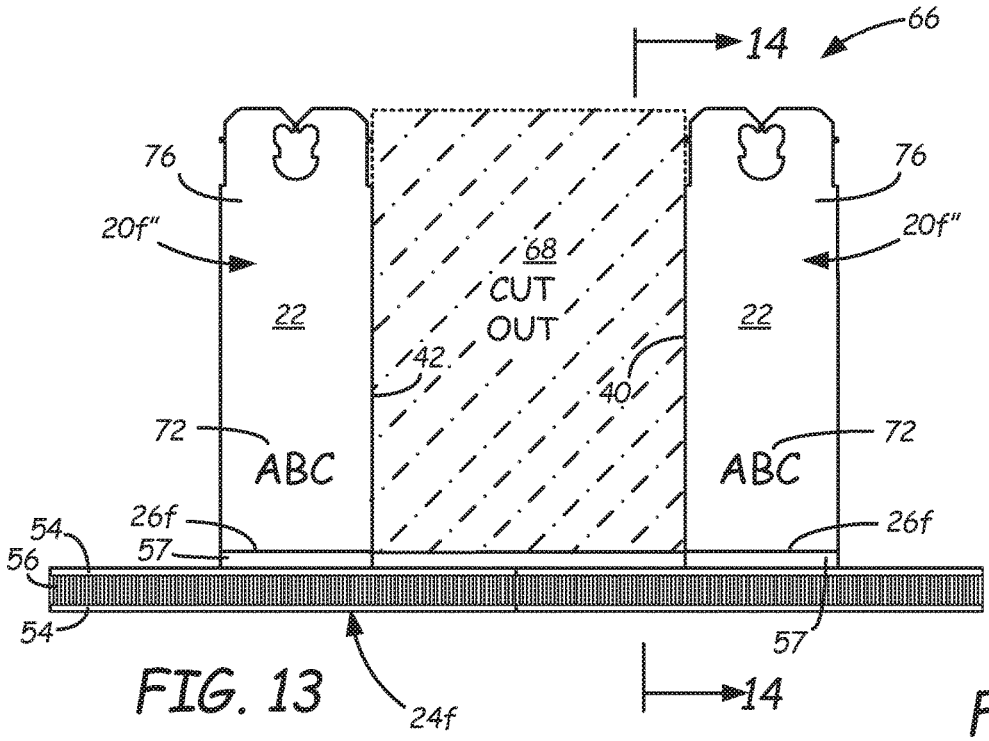
FIG. 13 shows a second exemplary arrangement of a plurality of closure articles.

FIG. 13 is a front view of a second exemplary arrangement 66 of a plurality of rupturably connected closure articles. As illustrated, each closure article 20*f*" is formed so that auxiliary fastener 24*f* is connected to tag 22 at a butt joint 26*f*. As shown in FIG. 14, butt joint 26*f* joins wing 57 of auxiliary fastener 24*f* and tag 22. To accommodate for the extension of auxiliary fasteners 24*f* beyond the side edges 40, 42 of tags 22, a cut out portion 68 of tag material is provided between adjacent tags 22. In an exemplary manufacturing method, material of this cut-out portion 68 is recycled in a subsequent process for forming additional tags 22. Arrangement 66 can be formed by cohesion of the material for tag 22 and auxiliary fastener 24*f*, with the cut out portions 68 removed thereafter.

FIGS. 15 and 16 illustrate another exemplary embodiment of a closure article 20*g*. In this embodiment, auxiliary fastener 24*g* is provided in the form of an elastic sheet bonded to a surface of tag 22 underlying at least a portion of aperture 52 (such as, for example, across coextensive zone 29). In an exemplary embodiment, joint 26*g* is located at the mutually bonded overlap of tag 22 and the elastic sheet of auxiliary fastener 24*g*. In the front view of FIG. 15, a portion of the auxiliary fastener 24*g* is visible through slit 50 and aperture 52 of tag 22. Auxiliary fastener 24*g* includes a cut or slit 70 provided in the flexible elastic material of auxiliary fastener 24*g*. In use, a gathered neck of a flexible container such as a bag (such as neck 98 of bag 94, shown in FIG. 25) would be inserted into slit 70, which is coincident with slit 50 and aperture 52 of tag 22. Accordingly, closure article 20*g* provides a more secure attachment of tag 22 on a product bag than would be accomplished by the simple fictional engagement of aperture 52 with the bag. The elastic material of auxiliary fastener 24*g* directly engages the bag along slit 70, which deforms and grips the bag. In an exemplary embodiment, auxiliary fastener 24*g* is attached at joint 26*g* to at least a portion of tag 22 that includes aperture 52 (as at coextensive zone 29). While a particular curvilinear embodiment of slit 70 is illustrated (e.g. a hook-shaped slit), it is contemplated that such an opening in auxiliary fastener 24*g* can be provided in other configurations, including not only slits of other configurations, but also barbed configurations, apertures and combinations thereof.

FIGS. 17 and 18 illustrate another exemplary embodiment of a closure article 20*h*, in which an auxiliary fastener 24*h* is attached to tag 22 at joint 26*h* (such as at coextensive zone 26*h*); the elastic sheet of auxiliary fastener 24*h* underlies at least a portion of aperture 52. In this embodiment, the elastic sheet material of auxiliary fastener 24*h* underlies only a portion of aperture 52 of tag 22. Auxiliary fastener 24*h* thus effectively reduces the size of aperture 52 and provides an elastic biasing force on a bag portion inserted therein to more securely hold tag 22 of closure article 20*h* on the product bag. Auxiliary fastener 24 may also enhance the secure closure of the bag via its contact with the elastic auxiliary fastener 24*h*.

Figure 19:
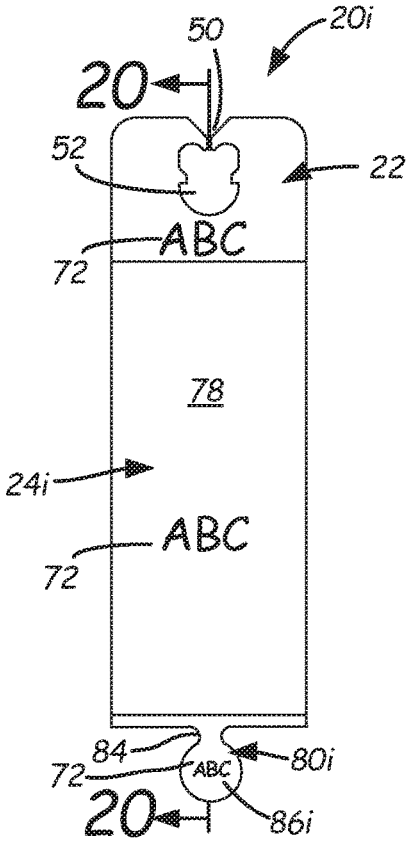
FIG. 19 is a front view of a tenth exemplary embodiment of a closure article.
Figure 20:
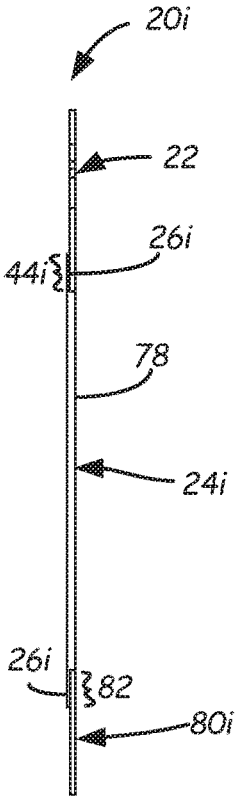
FIG. 20 is a cross-sectional view taken along line 20-20 of FIG. 19.
Figure 21:
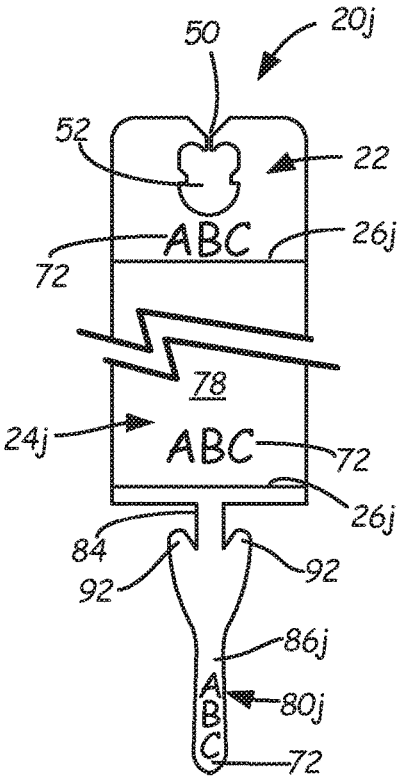
FIG. 21 is a front view of an eleventh exemplary embodiment of a closure article.

FIGS. 19, 20 and 22-24 illustrate another exemplary embodiment of a closure article 20*i*, in which an auxiliary fastener 24*i* is attached to tag 22 at bond zone 44*i*. In the illustrated exemplary embodiment, auxiliary fastener 24*i* includes an elastic sheet 78 joined to tab 80*i* at bond zone 82. As shown in FIGS. 19 and 21, closure articles 20*i* and 20*j* are substantially similar except for the shape of tabs 80*i*, 80*j*, respectively. Accordingly, descriptions with respect to one of the closure articles 20*i*, 20*j* apply to both embodiments unless otherwise indicated. In exemplary embodiments, tabs 80*i*, 80*j* may be formed of a material that is similar to a material used for tag 22. In other embodiments, the material for tab 80*i*, 80*j* is different from that used for tag 22, but is relatively stiffer than a material of elastic layer 78.

Figure 22:
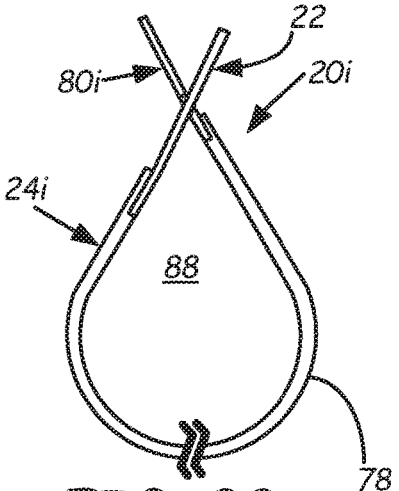
FIG. 22 is a side elevation view of the closure article of FIGS. 19 and 20 in a bent configuration.
Figure 23:
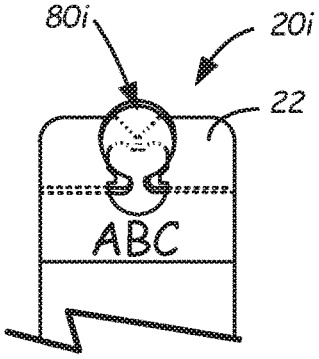
FIG. 23 is a partial front view of the closure article of FIGS. 19, 20 and 22 in the bent configuration of FIG. 22.

As shown in FIGS. 22 and 23, in an exemplary use of closure article 20*i*, elastic layer 78 is bent so that head 86*i* of tab 80*i* is twisted and inserted, via slit 50, into aperture 52 of tag 22. In an exemplary embodiment, tab 80*i* is formed with a relatively narrow neck 84 and a larger dimensioned head 86*i*. The narrow neck 84 facilitates insertion through slit 50, while the larger dimensioned head 86*i* prevents unintentional removal of head 86*i* from aperture 52 or slot 50. Thus, in an exemplary use, insertion of tab 80*i* into aperture 52 results in a bent configuration of closure article 20*i* that can be maintained despite tension placed by articles inserted within loop 88.

FIG. 23 shows a partial front view of closure article 20*i* in the looped configuration of FIG. 22. To enhance the engagement of tab 80 within tag 22, other configurations of tab 80 can be devised, such as the configuration illustrated in FIG. 21 for tab 80*j*, for example. In the illustrated configuration, tab 80*j* includes neck 84 and a head 86*j* including opposed barbs 92 extending from head 86*j* beyond neck 84. In a bent configuration of closure article 20*j*, similar to that shown for closure article 20*i* in FIG. 22, barbs 92 facilitate engagement and retention of head 86*j* at aperture 52 of tag 22.

Figure 24:
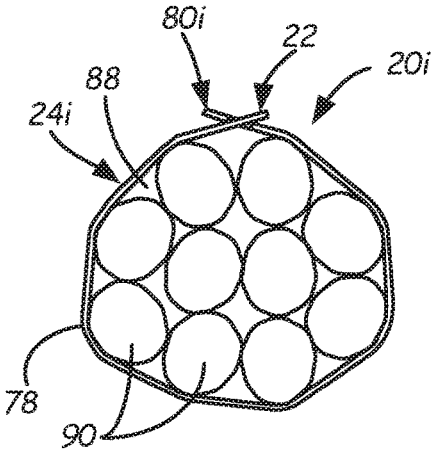
FIG. 24 is a side elevation view, similar to that of FIG. 22, with the closure article expanded about a bundle of products.

As shown in FIG. 24, closure article 20*i* is shown with elastic layer 78 in a stretched or extended state about a bundle of a plurality of products 90. The compressive force of the elastic layer 78, as stretched about the products 90, helps to maintain even irregularly shaped product articles, such as broccoli stems, in a bundle. Moreover, as shown in FIGS. 19-21 and 23, indicia 72 may be provided on any or all of tag 22, elastic layer 78, or tab 80.

Figure 25:
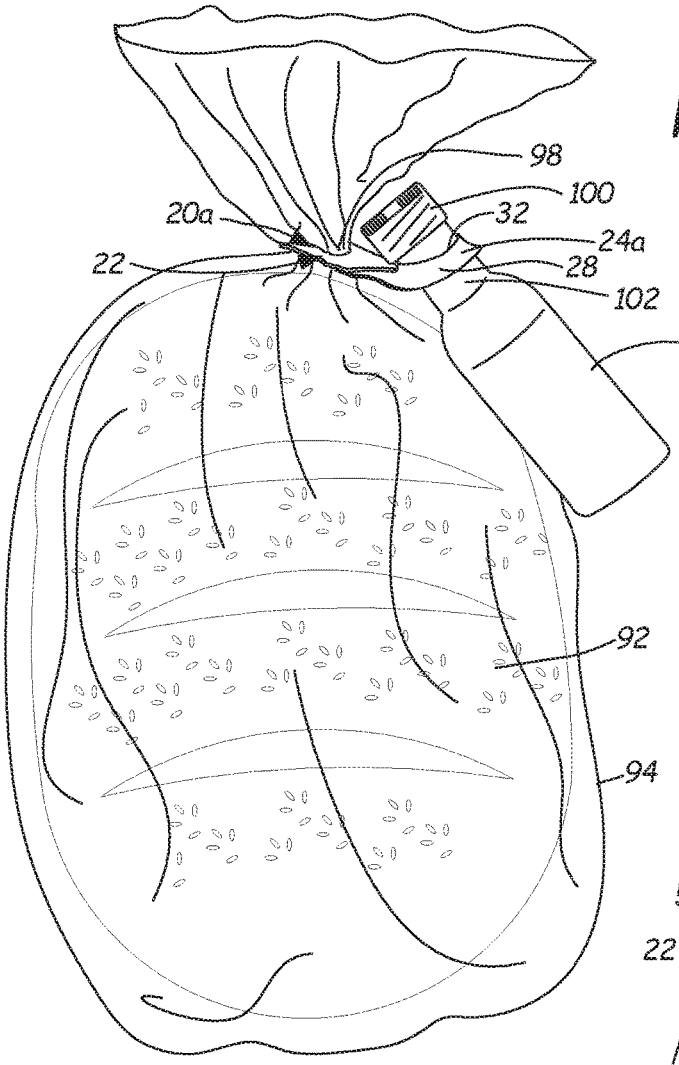
FIG. 25 is a perspective view of the first exemplary embodiment of a closure article in use to close a first product bag and attach second product.
Figure 26:
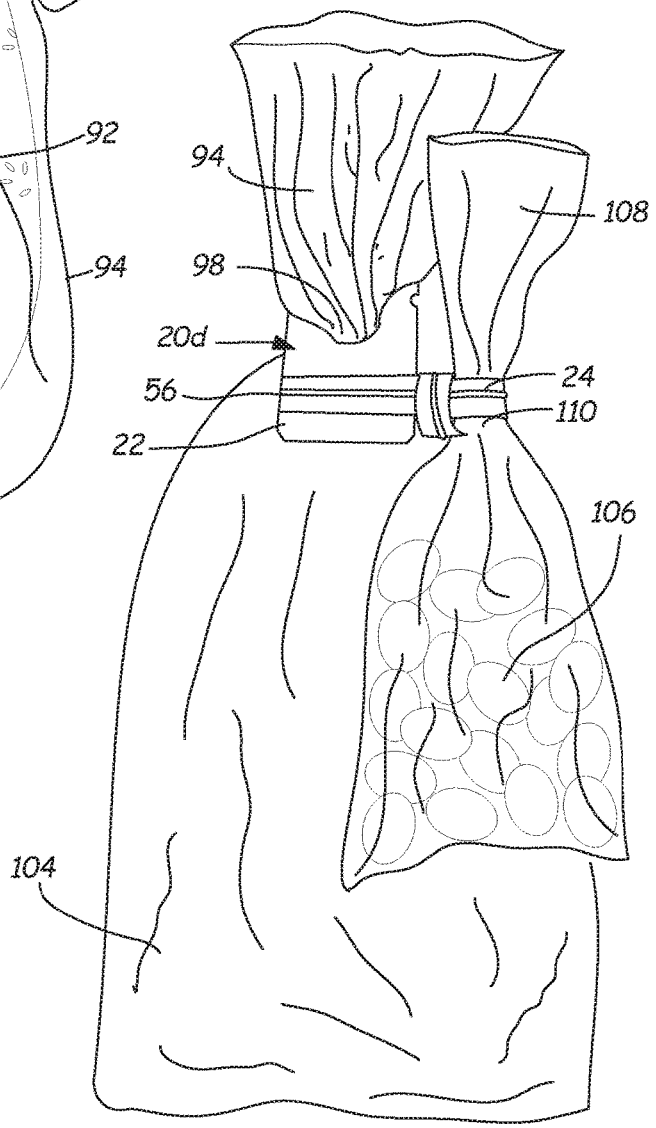
FIG. 26 is a perspective view of the fourth exemplary embodiment of a closure article in use to close a first product bag and attach second product.

FIG. 25 is a perspective view of closure article 20*a* used with a first product 92 to close a bag 94 containing the first product 92 and to attach a second product 96. It is contemplated that closure articles 20*b* and 20*c* may be used similarly and in other manners as desired to connect at least two products or bundled articles. As illustrated, first product 92 is a loaf of bread and second product 96 is a bottle of olive oil. It is contemplated that any of a variety of complementary or otherwise related products can be attached to each other. For example, the second product may be a sample offered by the same manufacturer as the first product. As shown in FIG. 25, the first product 92 is contained within a flexible bag 94. To close the bag 94, a user or machine cinches the bag 94 at a neck 98 and inserts the gathered neck 98 of the bag 94 into aperture 52 of tag 22 via slit 50. A user or machine inserts a portion of second product 96, such as cap 100 through aperture 32 of loop 28. In an exemplary embodiment, loop 28 is dimensioned to stretch around cap 100 to allow its passage through aperture 32 and then conform to a relatively smaller dimension of neck 102 of second product 96 so that compressive forces of the elastic material of auxiliary fastener 24*a* maintains the attachment of second product 96 to bag 94 and therefore to first product 92.

In an exemplary embodiment, retention wire 54 has dead fold properties, by which each of the auxiliary fasteners 24*d*, 24*e*, 24*f* can be maintained in a bent or twisted configuration. It is contemplated that auxiliary fastener 24*d*, 24*e*, 24*f* could be bent or twisted around a second product or a bundle of second products for attachment to tag 22 and its attached first product.

FIG. 26 is a perspective view of closure article 20*d* in use with first product 104 (contained in first bag 94) and second product 106 contained in second bag 108. In the illustrated embodiment, each of first product 104 and second product 106 is a collection of a plurality of pieces. In the one example, first product 104 is a collection of candies and second product 106 is a collection of jelly beans. However, products 90, 92, 104 and 106 may be any items of any configuration.

In the illustrated embodiment, the second bag 108 containing the second product 106 is attached to first product 104 via closure article 20*d*. As shown, closure strip 56 is provided in the form of a twist tie article. Closure strip 56 including retention wire 54 is tightened and twisted about itself around the gathered neck 110 of bag 108. Thus, closure article 20*d* simultaneously closes bag 108 and attaches the bag 108 to the first bag 94, which is closed by the insertion of its neck 98 in a gathered configuration in aperture 50 of tag 22.

Figure 27:
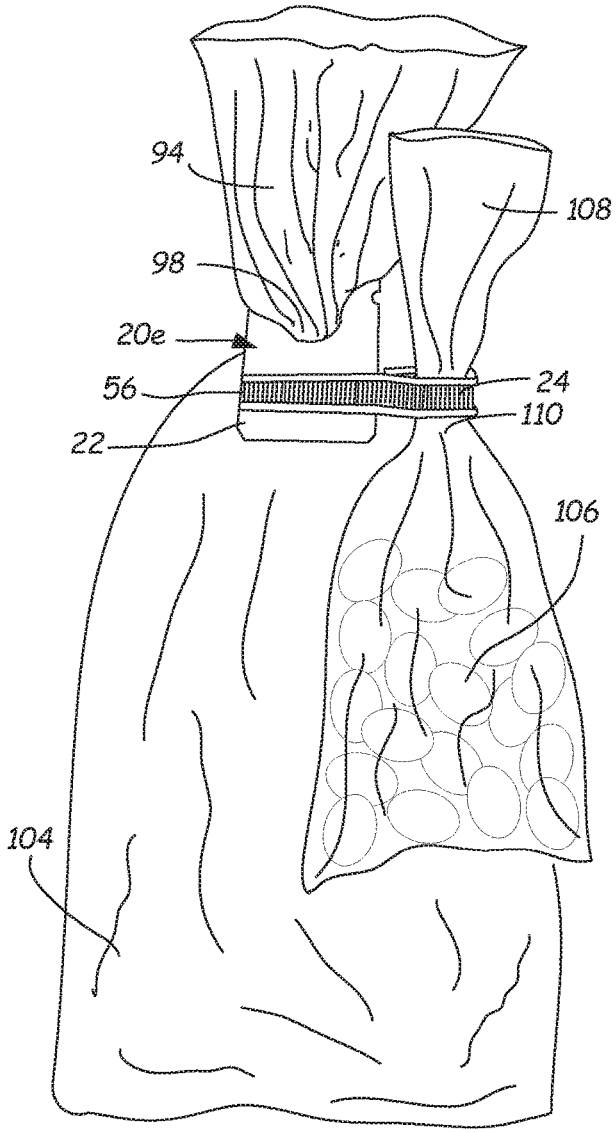
FIG. 27 is a perspective view of the fifth exemplary embodiment of a closure article in use to close a first product bag and attach second product.

FIG. 27 is a perspective view of closure article 20*e* in use with first product 104 (contained in first bag 94) and second product 106 contained in second bag 108. In the illustrated embodiment, the second bag 108 containing the second product 106 is attached to first product 104 via closure article 20*e*. As shown, closure strip 56 is provided in the form of a tin tie article, including two parallel retention wires 54. As illustrated, an end of closure strip 56 is rolled or folded around the gathered neck 110 of bag 108. Thus, closure article 20*e* simultaneously closes bag 108 and attaches the bag 108 to the first bag 94, which is closed by the insertion of its neck 98 in a gathered configuration in aperture 50 of tag 22.

Figure 28:
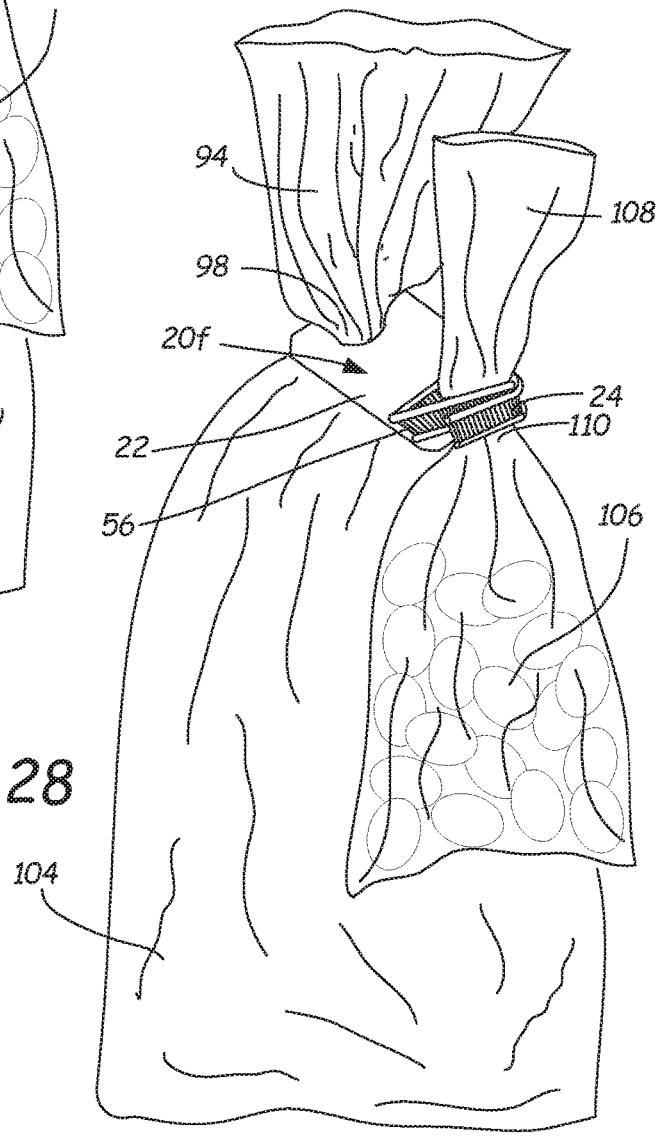
FIG. 28 is a perspective view of the sixth exemplary embodiment of a closure article in use to close a first product bag and attach second product.

FIG. 28 is a perspective view of closure article 20*f* in use with first product 104 (contained in first bag 94) and second product 106 contained in second bag 108. In the illustrated embodiment, the second bag 108 containing the second product 106 is attached to first product 104 via closure article 20*f*. As shown, closure strip 56 is provided in the form of a tin tie article, including two parallel retention wires 54. As illustrated, two opposite ends of closure strip 56 are rolled or folded around the gathered neck 110 of bag 108. Thus, closure article 20*f* simultaneously closes bag 108 and attaches the bag 108 to the first bag 94, which is closed by the insertion of its neck 98 in a gathered configuration in aperture 50 of tag 22.

While the illustrations show that a product in a larger bag is closed with tag 22 and a smaller product is attached with the auxiliary fastener 24, it is contemplated that two mutually connected products may be about the same size or that the product attached to the auxiliary fastener 24 may be larger than the product attached to tag 22. Moreover, in FIGS. 26-28, while strip 56 is illustrated as being fastened about the neck of a bag, it is contemplated that the strip 56 can be attached to other portions of products such as bottle necks and other parts of products having different configurations. In one example, if a second product or its packaging has a hanging aperture, strap or loop, the strip 56 can be inserted into or about the hanging structure to connect the second product to a first product attached to tag 22. Other methods of use can be devised, depending on product and packaging configurations.

In exemplary embodiments, tags 22 are formed of a stiffly resilient sheet plastic material that allows for deformation in use for ease of insertion of a portion of a bag into aperture 52 and removal of the portion of the bag therefrom. As described, the present disclosure describes a closure article with an auxiliary fastener that can be used in multiple manners to close a product container such a flexible bag, attach a second product to the first product and/or bundle a plurality of products.

Rectangular style tags 22 are especially practical for economy purposes, but tags may take different forms such as octagonal shapes, triangular shapes, rhomboidal shapes, circular shapes, oval shapes, and irregular shapes. The tag material should be flexible and pliable but is preferably not elastic, and is therefore dimensionally stable, for most applications. In some embodiments, indicia 72 are provided on front surface 74 and/or back surface 76 of tag 22. Such indicia 72 may be printed, embossed, or otherwise provided. In exemplary embodiments, indicia 72 are sufficiently water resistant to avoid disintegration or destruction when repeatedly subjected to water and washing operations (as is common for produce displays in supermarkets). The sheet material for the tag 22 also should be somewhat tough in the sense of being sufficiently tear resistant to deter damage to it during storage, transport and display, or by staff or customer handling.

Especially suitable materials for forming the tag 22 and/or tab 80 include woven or non-woven fabrics, woven or non-woven films, paper, polymers, polystyrenic thermoplastics, polyolefinic thermoplastics, polyesters, and others that exhibit the properties discussed (which can vary depending on how the article is to be use). Suitable materials include thermoplastic materials and polymers of styrene, ethylene, propylene, as well as a variety of other monomers and mixtures of monomers (e.g., to make co-polymers and ter-polymers, etc.). Suitable materials also include PLA (poly lactic acid) resin materials. Any of a variety of commercially available inks compatible with, or accepted on, a tag sheet and retained thereon, and in any desired color, may be used to print indicia 72 on tag 22 if desired. Moreover, if it should be desired to use water-soluble ink markings, a thin film of water-insoluble plastic may be applied over the ink to enhance water resistance.

Exemplary materials for forming the elastic layer for auxiliary fastener 24*a*, 24*b*, 24*c*, 24*g*, 24*h*, 24*i*, 24*j* are rubber-like in character in that they can bounce back from a stretched condition relatively quickly, but absolutely instantaneous retraction or bounce back to an original relaxed condition after stretching is not always critical for functional elastic performance. A variety of elastomers giving satisfactory elasticity and stretchability include thermoplastic elastomers that are at least heat softenable and even heat meltable to a flowable or moldable state. One of the more common families of thermoplastic elastomers include styrenic block co-polymers. This family includes styrene-butadiene styrene and styrene-ethylene-butylene styrene. Another family of useful thermoplastic elastomers include olefinic elastomers, especially those based on ethylene and polypropylene (e.g., where interposed different monomer blocks are not used but blocks of different tacticity—atactic and isotactic—are created by using metallocene catalysis polymerization). Yet another family of thermoplastic elastomers include polyvinyl chloride-based elastomers. Still other families of thermoplastic elastomers can be based on urethanes, nylon, and silicon, for example.

Selection of an elastomer material may take into account factors such as cost and bonding compatibility with a material of tag 22. Auxiliary fastener 24 is bonded to tag 22 at their mutual joint 26 using any suitable bonding technique, such as heat sealing, adhesive application, and the like. By "bonded," it is meant that the Auxiliary fastener 24 and tag 22 are cohered together so that they are integrated as parts of a single unit (e.g., closure article 20) and do not mutually separate in use. Exemplary use applications are illustrated in FIGS. 24-28. Auxiliary fastener 24 and tag 22 remain connected to each other despite tension forces placed on joint 26 by the weight of attached products.

Generally, similar materials tend to bond together (as by polymer bonding) better than dissimilar materials; and materials of like polarity usually bond better than materials of unlike polarity. Thus, tag material selection can be made from polymers in the same family as the elastomer, such as those including at least some monomers related to, or the same as those present in, the elastomer chosen for the elastic layer of auxiliary fastener 24*a*, 24*b*, 24*c*, 24*g*, 24*h*, 24*i*, 24*j*. Surface treatments such as corona treatments also help to improve bonding. Still further, compatibilizers that adjust the polarity of material can be used to improve bonding. Additional information is described in U.S. Pat. No. 8,635,795 to Ludlow et al.; U.S. Pat. No. 9,105,205 to Ludlow et al.; and U.S. Patent Application Publication No. 2015/0239615 to O'Donnell, et al., all of which are hereby incorporated by reference. A common practice in handling polymeric materials for tag 22 and an elastic layer for auxiliary fastener 24*a*, 24*b*, 24*c*, 24*g*, 24*h*, 24*i*, 24*j* is to add compatible (i.e., readily blendable) ingredients to achieve desired properties such as coloration, opacification, resistance to degradation on exposure to environmental conditions, improved impact properties and adhesion properties, for example.

Heat welding as by applying heat and pressure on overlapping thermoplastic polymeric materials forming the tag 22 and the elastic substrate of auxiliary fastener 24*a*, 24*b*, 24*c*, 24*g*, 24*h*, 24*i*, 24*j* can be useful to form the bond therebetween at joint 26. Sonic welding is another way to unify the layers and achieve a cohesive bond between compatible parts. Bonds can also be formed by interposing an intermediate layer at the joint 26 (e.g., a hot melt bonding adhesive) to which both the tag material and the elastic layer material will readily bond because of their compatibility to the intermediate material. Still further, treatment of the surface areas where bonding is to be accomplished can be effective. Even mechanical bonding can be effective, as where the tag material is porous (e.g., paper and the porous polymer product called "Teslin"), and the elastomeric layer is applied in molten condition or at least in a softened condition and pressed into the voids or interstices of the porous tag layer. Any useful bonding technique and structure that joins the tag 22 with the elastic layer of auxiliary fastener 24*a*, 24*b*, 24*c*, 24*g*, 24*h*, 24*i*, 24*j* in a manner forming a unifying flat joint 26 that can withstand delamination in expected use is suitable.

Those skilled in the art will recognize that any suitable process for the manufacture of closure articles 20 of the disclosure can be employed. Batch processing is useful for limited production runs. Conveyor processing with indexing from station to station for specific operations can be useful, especially for uniquely designed or shaped tags or elastic or tie substrates.

Web-based processing is especially suitable from the standpoint of economy. For example, for closure article 20*b*, a high impact polystyrene web is fed simultaneously with molten elastomer (e.g., a thermoplastic elastomer such as styrenic block copolymer) through the nip of chill rollers. The molten elastomer is applied to extend with a sufficient overlap onto the lateral edges of the web to create bond zone 44 as well as to extend sufficiently laterally outward from the bond zone (i.e, lateral edge of web) to provide material for dispersion zone 34 and elastic loop 28. The temperature of the chill rollers is adjusted to cool the molten elastomer to an at least partially cured state while simultaneously applying pressure (up to about 500 psi) to form the elastomer layer of auxiliary fastener 24*b* at the desired thickness and also to bond tag 22 to the elastomer layer of auxiliary fastener 24*b* at bond zone 44. Lateral and longitudinal positioning of the composite web (of tag and elastomer) is controlled as it is passed in proper registration between die cutting and anvil rollers to cut and score individual article profiles that are then severed into individual closure articles 20*b*.

Figure 30:
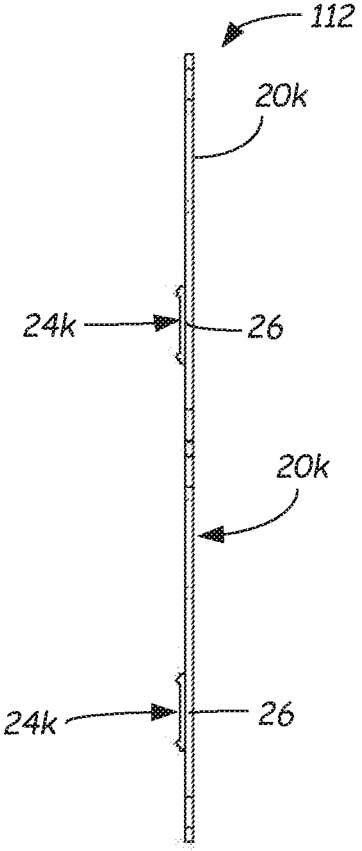
FIG. 30 is a side view of the third arrangement, as viewed from the right side of FIG. 29.
Figure 29:
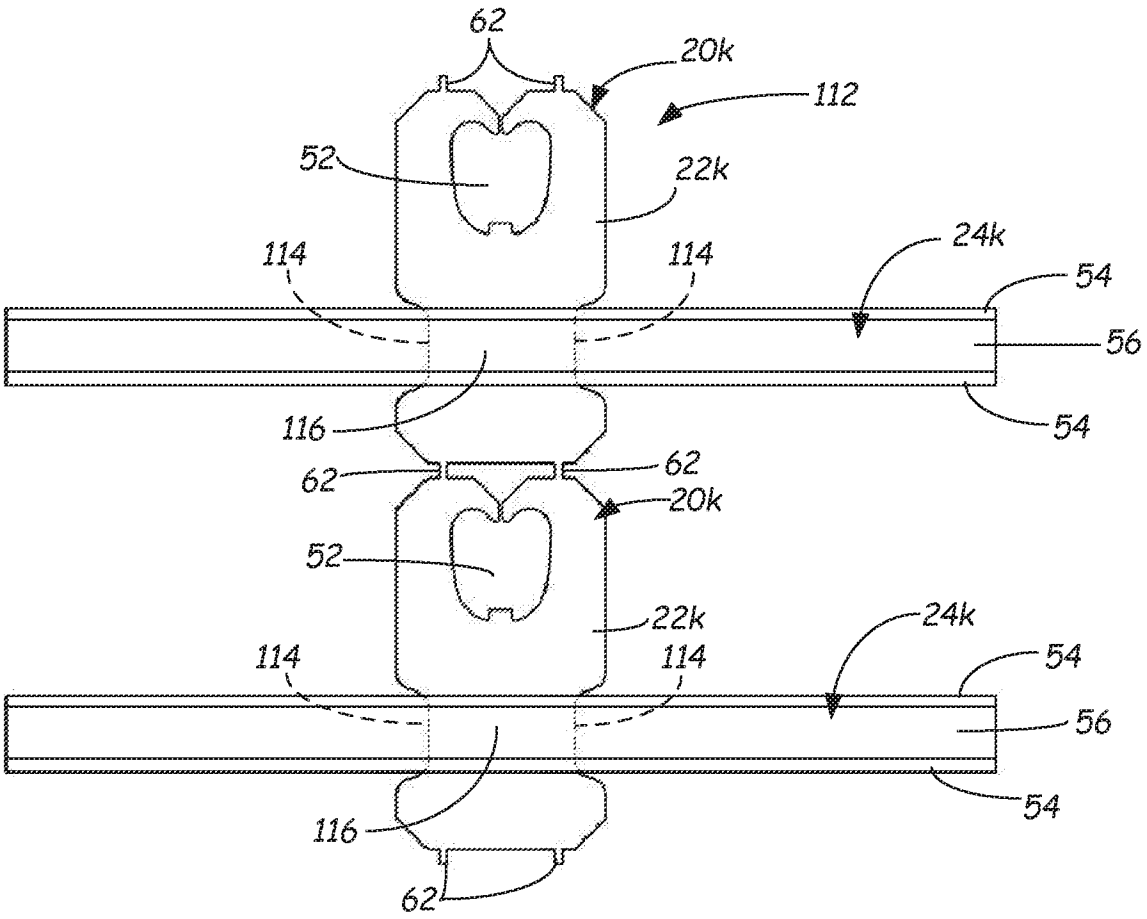
FIG. 29 shows a third exemplary arrangement of a plurality of closure articles, in which each is a twelfth exemplary embodiment of a closure article.
Figure 31:
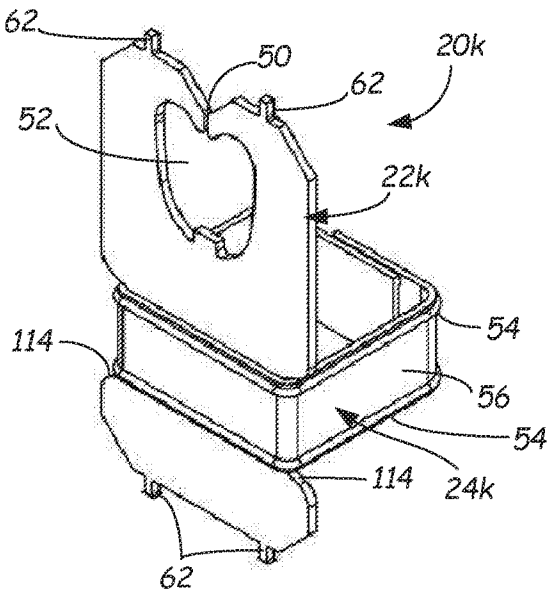
FIG. 31 is a perspective view of the twelfth exemplary embodiment of a closure article, with the auxiliary fastener in a bent configuration.
Figure 34:
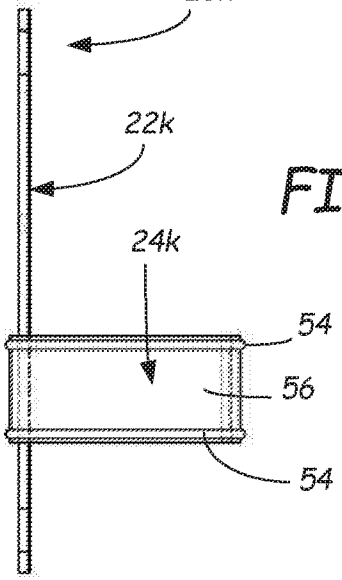
FIG. 34 is a side view of the closure article of FIG. 31.
Figure 33:
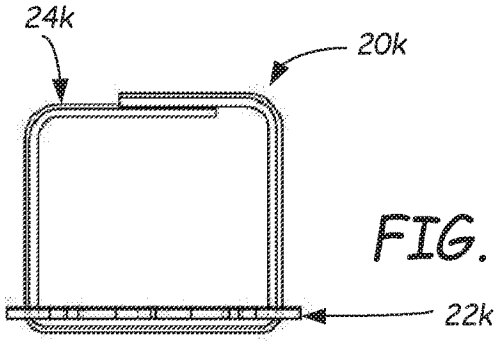
FIG. 33 is a top view of the closure article of FIG. 31.
Figure 32:
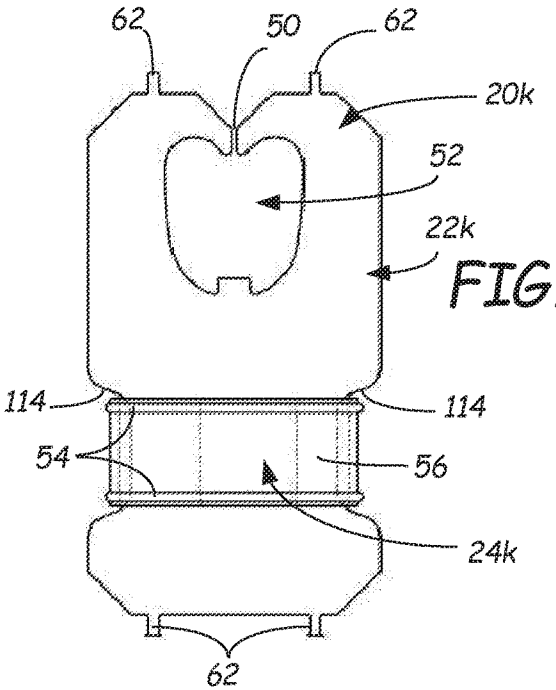
FIG. 32 is a front view of the closure article of FIG. 31.

FIGS. 29 and 30 show a third exemplary arrangement 112 of a plurality of closure articles 20*k*. In the illustrated embodiment, adjacent tags 22*k* are rupturably connected to each other via joints 62, which form breakable bridges between adjacent tags 22*k*. Thus, a plurality of closure devices 20*k* can be presented to a user in a connected arrangement 112, which may be provided in a flat or rolled spooled form. While only two closure articles 20*k* are depicted, it is to be understood that arrangement 112 may include any number of closure articles 20*k* similarly connected in a strip at breakable joints 62. In an exemplary embodiment, tag 22*k* includes side notches 114 to form a narrowed neck 116. In an exemplary embodiment, auxiliary fastener 24*k* in the form of strip 56 with retention wires 54 is centered on neck 116. However, it is contemplated that auxiliary fastener 24 of other configurations can be used, such as an elastomeric element or a strip with a single retention wire, for example.

FIGS. 31, 32, 33 and 34 are perspective, front, top and side views, respectively, of a single closure article 20*k* of arrangement 112, with the auxiliary fastener 24*k* in a bent configuration. Such a bent configuration of auxiliary fastener 24*k* could be useful for wrapping around a portion of a product, for example. Though one configuration is shown, it is contemplated that auxiliary fastener 24*k* may be bent, rolled, twisted, or otherwise configured. As illustrated, because auxiliary fastener 24*k* bends around notches 114 of tag 22*k*, the notches 114 serve to offer a mechanical attachment means for auxiliary fastener 24*k* to tag 22*k*, rather than relying solely on an adhesive or other bonding of auxiliary fastener 24*k* to tag 22*k* at joint 26.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. An article including:

a tag having a perimeter, the tag including an aperture and a first cut connecting the aperture and the perimeter;

an elastic panel bonded to the tag; and a tab bonded to the elastic panel at a joint, wherein the tab is formed of a different material than the elastic panel, wherein a portion of the tab is configured for insertion into the aperture.

2. The article of claim 1, wherein the tab includes a head that is spaced from the joint.

3. The article of claim 2, wherein the tab includes a neck between the head and the joint.

4. The article of claim 3, wherein the neck is narrower than the head.

5. The article of claim 2, wherein the head includes a first barb.

6. The article of claim 5, wherein the head includes a second barb disposed opposite the first barb.

7. The article of claim 1, wherein the joint is located at an overlap of the elastic panel and the tab.

8. The article of claim 1, further including indicia disposed on the tag.

9. The article of claim 1, further including indicia disposed on the elastic panel.

10. The article of claim 1, further including indicia disposed on the tab.

11. An article including:

a tag having a perimeter, the tag including an aperture and a first cut connecting the aperture and the perimeter;

an elastic panel bonded to the tag; and a tab bonded to the elastic panel at a joint, wherein a portion of the tab is configured for insertion into the aperture, wherein a material of the tab is stiffer than a material of the elastic panel.

12. A method of attaching an article to a product, the method including:

obtaining the article including:

a tag having a perimeter, the tag including an aperture and a first cut connecting the aperture and the perimeter;

an elastic panel bonded to the tag; and a tab bonded to the elastic panel at a joint, wherein the tab is formed of a different material than the elastic panel;

wrapping the elastic panel around at least a portion of the product; and inserting a portion of the tab into the aperture.

13. The method of claim 12 including twisting a head of the tab and inserting the head through the first cut.

14. The method of claim 12 including stretching the elastic panel around the portion of the product.

15. The article of claim 11, wherein the tab includes a head that is spaced from the joint.

16. The article of claim 15, wherein the tab includes a neck between the head and the joint.

17. The article of claim 16, wherein the neck is narrower than the head.

18. The article of claim 15, wherein the head includes a first barb.

19. The article of claim 18, wherein the head includes a second barb disposed opposite the first barb.

20. The article of claim 11, wherein the joint is located at an overlap of the elastic panel and the tab.

* * * * *